US005257422A

United States Patent [19]

Rüegg

[11] Patent Number: 5,257,422

[45] Date of Patent: Nov. 2, 1993

[54] DRAIN CONNECTION ON A SANITARY ARTICLE

[75] Inventor: Urs Rüegg, Jona, Switzerland

[73] Assignee: Geberit AG, Jona, Switzerland

[21] Appl. No.: 731,496

[22] Filed: Jul. 17, 1991

[30] Foreign Application Priority Data

Jul. 20, 1990 [CH] Switzerland ..... 2421/90

[51] Int. Cl.[5] ..... E03D 11/18

[52] U.S. Cl. ..... 4/307; 4/252.2; 4/DIG. 16

[58] Field of Search ..... 4/301, 307, 310, 311, 4/312, 252.1-252.6, DIG. 2, DIG. 13, DIG. 16

[56] References Cited

U.S. PATENT DOCUMENTS

| | | | |
|---|---|---|---|
| D. 231,930 | 6/1974 | Danks | 4/DIG. 16 X |
| 2,678,450 | 5/1954 | Simpson et al. | 4/312 |
| 3,534,778 | 10/1970 | Goecke | 4/DIG. 16 X |
| 3,742,522 | 7/1973 | Stevenson | 4/307 |
| 3,847,184 | 11/1974 | God | 4/DIG. 16 X |
| 3,860,978 | 1/1975 | Wirth | 4/679 |
| 3,873,137 | 3/1975 | Yamaguchi | 4/696 X |
| 3,967,324 | 7/1976 | Olive | 4/DIG. 16 X |
| 4,165,110 | 8/1979 | Itzler | 4/DIG. 16 X |
| 4,549,321 | 10/1985 | Douillard | 4/301 |
| 4,718,131 | 1/1988 | Kitamura et al. | 4/307 X |

FOREIGN PATENT DOCUMENTS

| | | | |
|---|---|---|---|
| 0467827 | 1/1992 | European Pat. Off. | 4/301 |
| 58677 | 3/1891 | Fed. Rep. of Germany . | |
| 1194931 | 11/1959 | France . | |
| 1502879 | 11/1967 | France . | |
| 0115928 | 10/1978 | Japan | 4/DIG. 16 |
| 0223233 | 9/1989 | Japan | 4/311 |
| 8103040 | 10/1981 | PCT Int'l Appl. | 4/252.3 |
| WO/8800993 | 2/1988 | PCT Int'l Appl. . | |
| 2178654 | 2/1987 | United Kingdom . | |

*Primary Examiner*—William A. Cuchlinski, Jr.
*Assistant Examiner*—John L. Beres
*Attorney, Agent, or Firm*—McGlew and Tuttle

[57] ABSTRACT

The bowl (18) of a urinal is detachably fastened with threaded bolts (20) to a building wall (19). After detaching the bowl (18), it can be swung away from the building wall (19) by a limited amount by a pivoting device (26, 27, 28) for maintenance of control devices (23) and fittings (21). The drain socket (24) is connected to the drain elbow (17) by a flexible line (12). In the use position of the urinal, a partially flexible siphon trap (12) is wound such that it forms a drain siphon. When the bowl (18) is swung away from the building wall (19), the flexible line (12) is stretched, and it is not necessary to detach the connection between the socket (24) and the drain elbow (17). The present invention permits simple maintenance of devices and fittings arranged covered behind the bowl (18).

8 Claims, 5 Drawing Sheets

DRAIN CONNECTION ON A SANITARY ARTICLE

FIELD OF THE INVENTION

The present invention pertains to a drain connection on a sanitary article with a connection to a drain line, and more particularly, a sanitary article such as a urinal, arranged on a building wall.

BACKGROUND OF THE INVENTION

Swiss patent application CH-A-666,504 of the applicant, discloses a siphon trap on a urinal which has become known in the state of the art. This trap is connected to the drain line via a horizontally extending connection pipe. In order not to have to detach the bowl from the wall for cleaning and maintenance of the urinal, the siphon trap is connected with a detachable connection piece to the drain socket of the bowl.

If such a urinal has further fittings and devices, e.g., a presence control device, behind the bowl, such a bowl nevertheless has to be regularly detached from the wall for maintenance purposes.

To carry out such maintenance or repair tasks without problems, a wall-mounted urinal has become known from EP-A-0,313,734, which has a two-part bowl. A bowl top part is rigidly connected to the wall, and a lower part is detachably connected to the top part. For maintenance of the fittings and devices arranged behind the bowl, the lower part is removed. However, a two-part bowl is not usually desirable for various reasons.

Furthermore, connections for sanitary articles, which are designed as bellows, as a flexible hose, or as a telescopic extension and permit the sanitary article to be pivoted to a certain extent, have become known from GB-A-2,178,654, DE-C-58,677, and WO-A-8,800,993. These connections are usually unsuitable for ordinary wall-mounted urinals, and they do not always guarantee a reliable trap effect.

SUMMARY AND OBJECTS OF THE INVENTION

It is an object of the present invention to provide a drain connection of the above-described class, which permits simple installation and maintenance of the sanitary article and of the devices and fittings arranged behind it even in the case of one-piece design of the bowl.

According to the invention, a drain connection on a sanitary article such as a urinal is provided with a connection part to a drain line arranged in a building wall. The connection part is provided in the form of moveable connection part means for moving the connection part while maintaining the connection by stretching at least in some sections, unfolding or pulling out and/or rotation about a joint when the urinal is moved away from the building wall for maintenance or the like. The connection part is preferably provided in the form of a siphon trap with a plurality of deformable beads at bend locations. Flexibility at these bends allows for an extension of siphon trap elements or the like. The connection part may also be a flexible tube with bends or curvatures extending substantially in a horizontal plane in a use position of the urinal and which is connected to a horizontal outlet of a siphon. The connection part may also be in the form of a bellows element which is connected to a siphon trap. The connection part may also be a pipe which has a flexible or elastic end which is pushed, axially displaceably, into the opening of a drain line.

The drain connection according to the present invention permits complete removal of the sanitary article from the building wall, without any part having to be previously detached between the drain socket of the bowl and the drain line. Thus, the present invention makes it possible to install a one-piece sanitary article, which can be moved away or swung away from the building wall very simply for maintenance of the devices and fittings arranged behind it. Thus, the sanitary article can be swung away from the building wall without previously detaching the siphon trap from the building wall, and the fittings and devices arranged behind it are very easily accessible from the side and from the top. The sanitary article may be made in one piece from a sanitary ceramic, and even its lower zone may be designed in the ordinary manner, i.e., it may be relatively slender.

According to a variant of the present invention, the connection part is a siphon trap that has at least partially stretchable bends. When moving away the sanitary article, the siphon trap is stretched in the zone of its bends. When the bowl is pushed back to the building wall after the maintenance, the siphon trap will automatically return to its original state. This design is particularly compact and inexpensive.

According to another embodiment of the present invention, a flexible hose tube connects the siphon trap to the drain line. A flexible hose tube is unfolded when the bowl is moved away from the building wall. The hose tube is swung in a horizontal plane here. An ordinary drain siphon can be used in this embodiment.

An ordinary drain siphon can also be used when, according to another variant of the present invention, the connection part is a bellows that connects the siphon trap to the drain line. The bellows can be rigidly connected to the drain line here.

According to another embodiment of the present invention, a connection part in the form of a pipe, which has a flexible or elastic end that is axially displaceably inserted into the opening of the drain line, is arranged on the siphon trap. When inserting the connection part into the drain line, the flexible or elastic end will automatically assume the usual curvature of the drain elbow. When the bowl is moved away from the building wall, the flexible or elastic end is stretched, and the connection part is partially pulled out of the drain line. The connection part can be pushed back into the drain line in a particularly simple manner if the flexible end is joined by an area made of a substantially more rigid material.

Further advantageous characteristics will become apparent from the following description and the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1A:
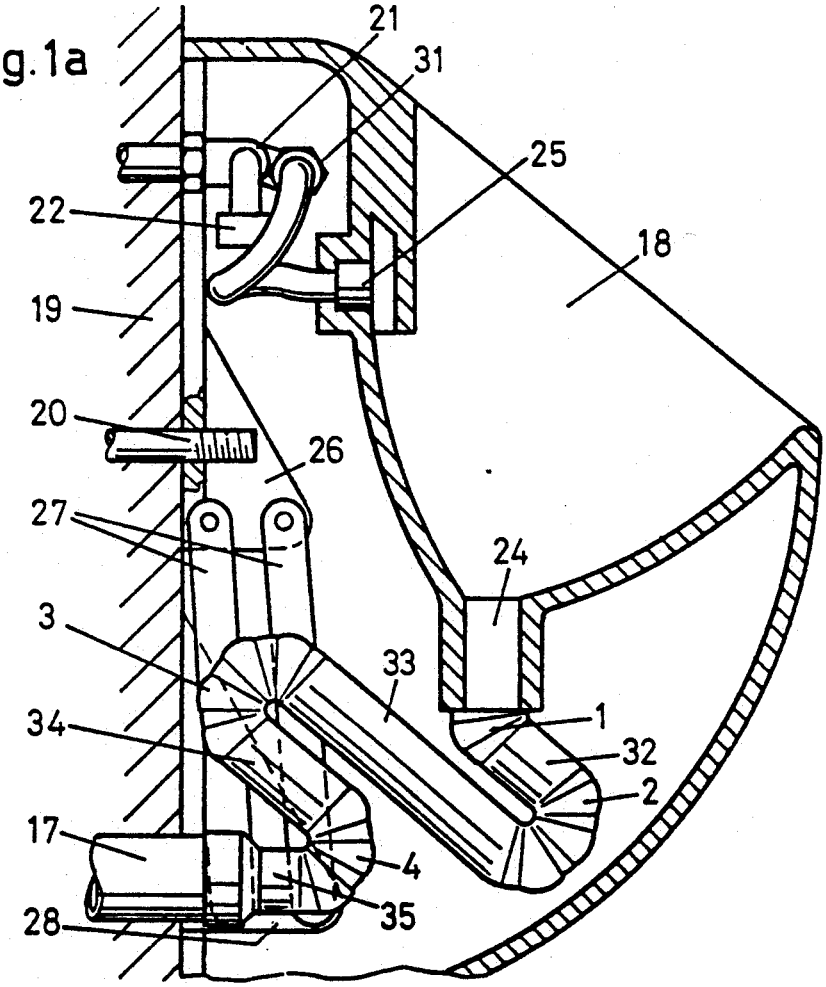
FIG. 1*a* is a vertical sectional view taken through a urinal fastened on a building wall, with a connection according to the present invention.

All the designs shown according to the preferred embodiment of the invention have a bowl made of, e.g., sanitary ceramic, which has a covered flushing insert 25 and a drain socket 24. With bolts 20 that are rigid parts of the wall and nuts (not shown here), the bowl 18 is detachably fastened to a wall box 23 or directly to the building wall. The bowl 18 has corresponding holes (not shown here) for said bolts 20. This type of fastening of a urinal bowl on a building wall has been known. A corner valve 21, a solenoid valve 31, as well as a rinsing control device 22, which are completely covered by the bowl 18, are arranged on said wall box 23. These parts are covered on all sides and are thus extensively protected from vandalism.

Figure 1B:
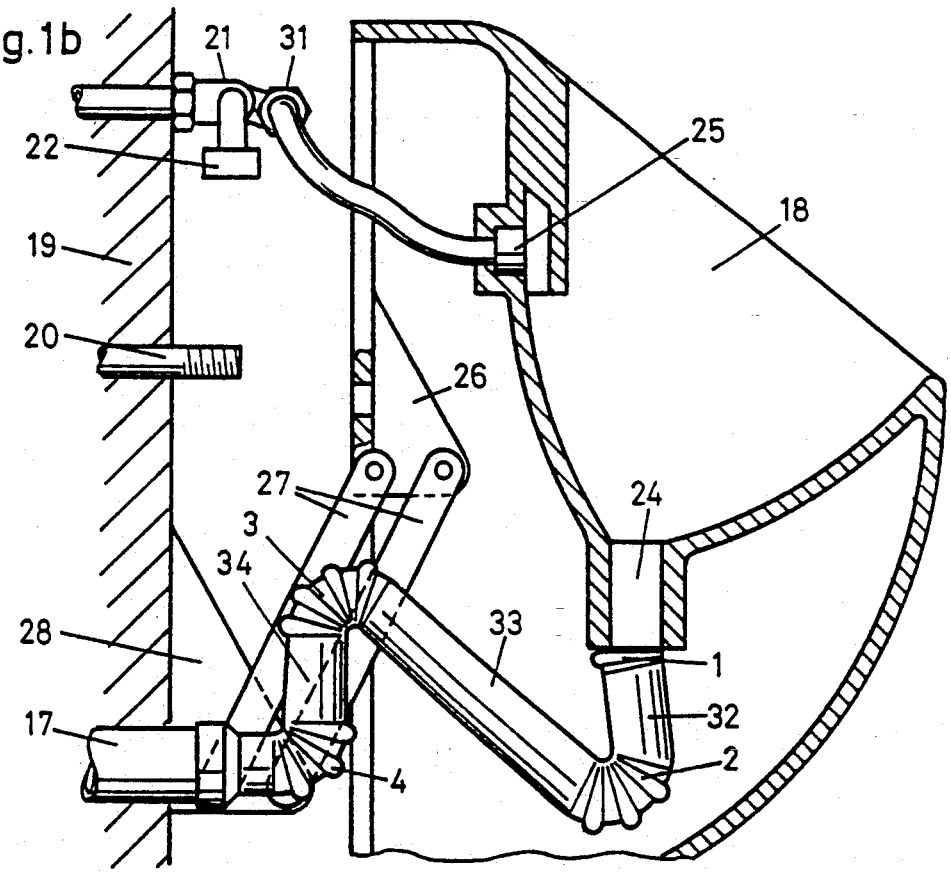
FIG. 1*b* is a sectional view of the urinal according to FIG. 1*a*, wherein the bowl is moved away from the building wall.
Figure 1C:
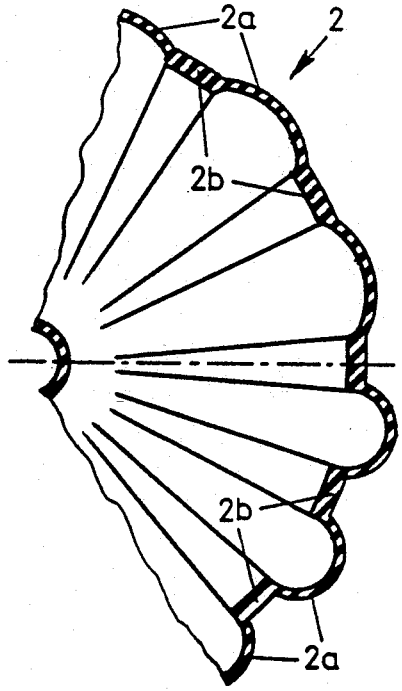
FIG. 1*c* is a sectional view taken through part of FIG. 1*a* on a larger scale.

The bowl 18 can be swung away from said building wall 19 into the position shown in FIG. 1*b* with two parallel connecting rods 27, which are hinged to a support 26 arranged on the bowl 18 and are pivotably mounted on a support 28 that is a rigid part of the wall. The control device 22 and the fitting 21 are visible with the bowl 18 swung away, and readily accessible for maintenance from the top as well as from the bottom. To swing the bowl 18 away from the building wall 19, the bowl 18 merely needs to be detached from the bolt 20. After the maintenance work has been performed, the bowl 18 is again swung back to the building wall 19, and fixed with the bolts 20 and the nuts (not shown here), or with another suitable fastening device.

In the embodiment according to FIGS. 1*a* and 1*b*, the socket 24 leads via a siphon trap 12 to a drain line 17. The siphon trap 12 is tightly connected to the socket 24 and the drain elbow 17. In the use position shown in FIG. 1*a*, the siphon trap 12 has three elastically stretchable bends 2, 3, and 4. Straight and relatively dimensionally stable sections 32–35 are arranged between the bends 2, 3, and 4. The bends 2, 3, and 4 each provide a reversal of direction of flow. In the use position, the siphon trap 12 is located in a vertical plane. If the bowl 18 is swung away from the building wall, the siphon trap 12 is stretched, and it will assume the shape shown in FIG. 1*b*. The two ends of the siphon trap 12 are also tightly connected to the socket 24 and the drain line 17. Maintenance of the devices and fittings arranged behind the bowl 18 is thus possible without having to remove and empty the siphon trap 12. It is also essential that relatively little space is needed for the siphon trap 12 beneath and behind the socket 24 in the use position. The bends 2, 3, and 4 each have a plurality of relatively thin-walled beads 2*a*, 3*a*, and 4*a*, between which respective sections 2*b*, 3*b* and 4*b* with greater wall thickness are arranged. On stretching, the siphon trap 12 is deformed mainly in the area of the beads 2*a*, 3*a*, and 4*a*. The siphon trap 12 is made of an elastomeric plastic, preferably EPDM. After molding, it is preferably cross-linked in order to reach high strength.

Figure 2A:
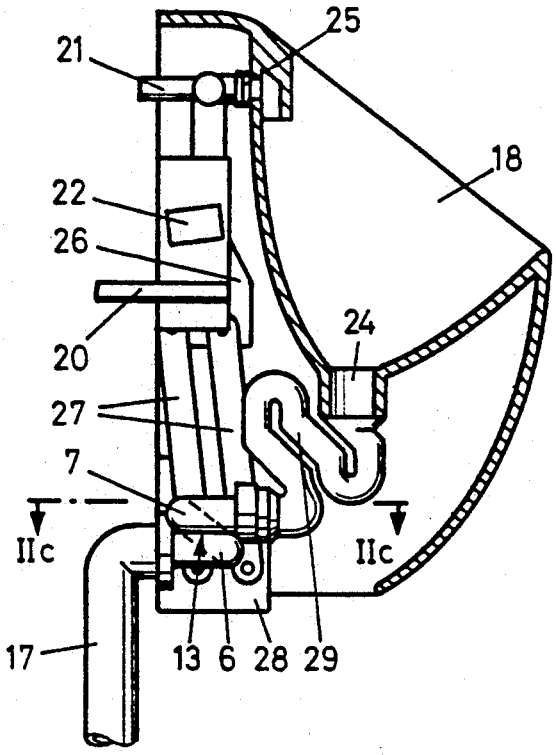
FIG. 2*a* is a vertical sectional view taken through a urinal with a drain connection according to a variant of the invention.
Figure 2C:
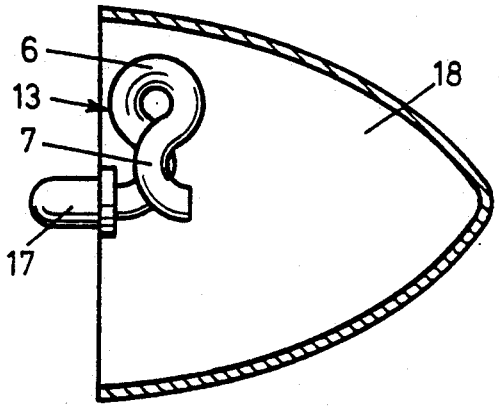
FIG. 2*c* is a horizontal sectional view taken along line II*c*—II*c* in FIG. 2*a*.
Figure 2B:
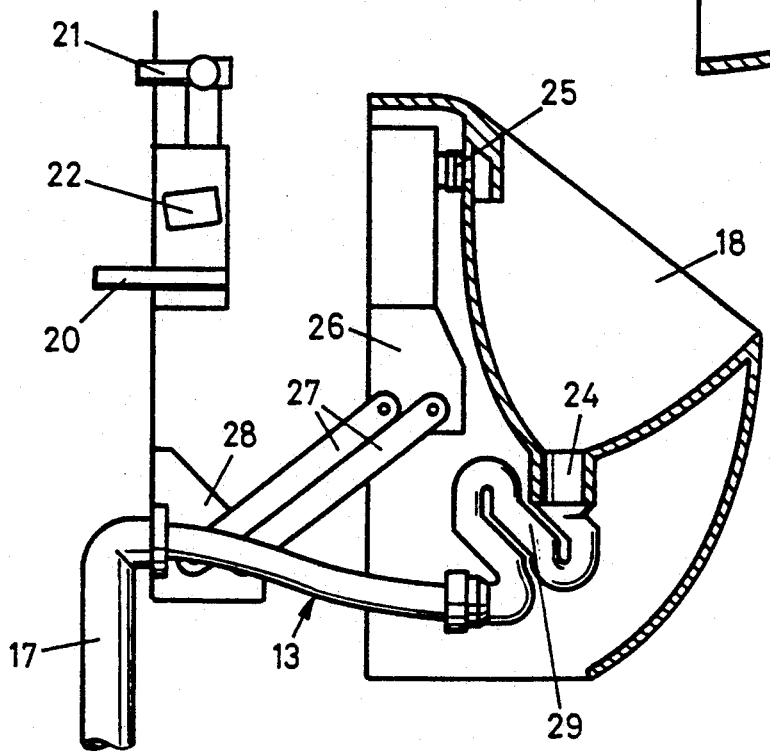
FIG. 2*b* is a sectional view of the urinal according to FIG. 2*a*, wherein the bowl is moved away from the building wall.

The urinal according to FIGS. 2*a* and 2*b* differs from this urinal in that an ordinary drain siphon 29 is connected to the socket 24, and that this drain siphon is also connected to the drain elbow 17 by a flexible hose tube 13. In the use position, the hose tube 13 has bends 6 and 7, which are located in horizontal, superjacent planes. The flexible hose tube 13 is preferably a hose tube which will automatically resume its original shape after stretching in the known manner.

Figure 3A:
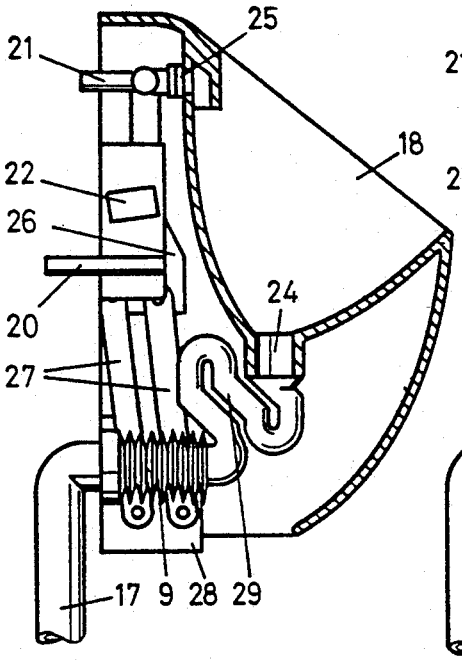
FIG. 3*a* is a vertical sectional view taken through a wall-mounted urinal with another variant of a drain connection according to the present invention.
Figure 3B:
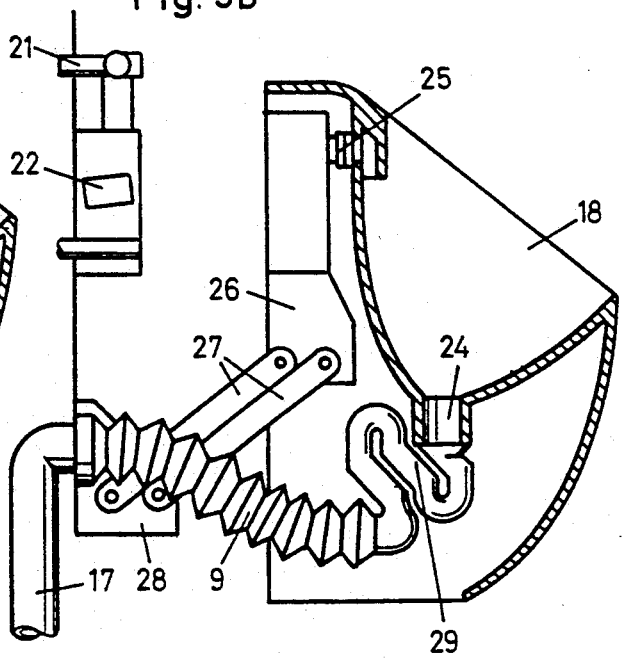
FIG. 3*b* is a urinal according to FIG. 3*a*, wherein the bowl is swung away from the building wall.

In the embodiment according to FIGS. 3*a* and 3*b*, a drain siphon 29 is connected to the drain line 17 by a bellows 9. When the bowl 18 is swung away from the building wall 19, the bellows 9 is stretched, without its ends becoming separated from the drain siphon 29 or the drain line 17. The bellows 9 is preferably a spiral hose.

Figure 4A:
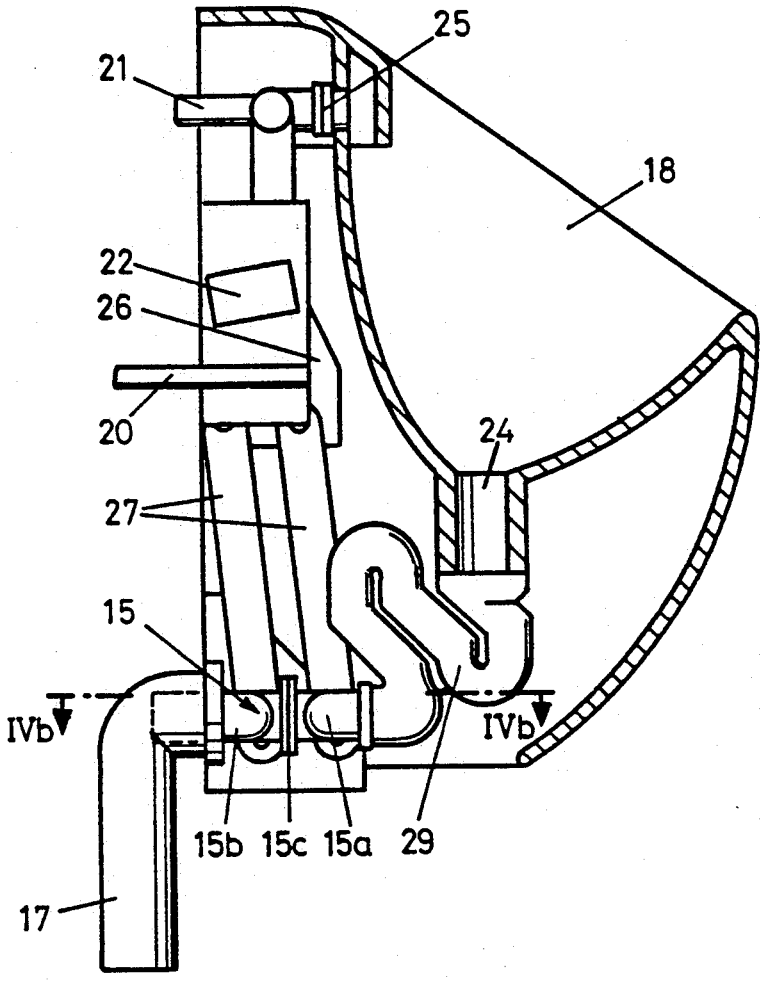
FIG. 4*a* is a vertical sectional view taken through a wall-mounted urinal with a drain connection according to another variant of the present invention.
Figure 4B:
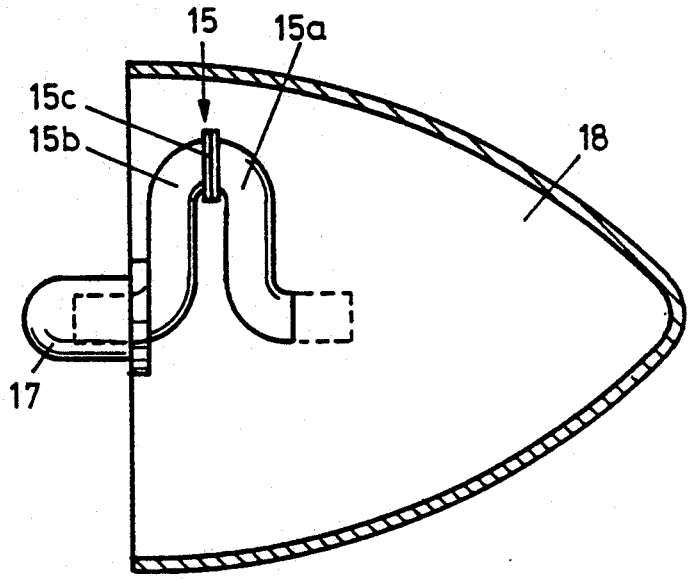
FIG. 4*b* is a sectional view taken along line IV*b*—IV*b* in FIG. 4*a*.

In the embodiment according to FIGS. 4*a* and 4*b*, the drain siphon 29 is connected to said drain line 17 by an articulated pipe elbow 15. The pipe elbow 15 consists of two pipe sections 15*a* and 15*b*, which are connected by a joint 15*c*. The pipe section 15*a* is rigidly connected to the horizontal outlet section of the siphon 29, and the end of the pipe section 15*b* is inserted into the opening of the drain line 17 such that the pipe section 15 can be displaced vertically relative to the wall in both directions, and the connection with the drain line is not interrupted. In the use position shown in FIG. 4*a*, the pipe elbow 15 extends in a horizontal plane. If the bowl 18 is swung away from the building wall 19, the pipe elbow 15 is first slightly pulled out of the drain line 17, so that it will extend into the opening of the drain line 17 only as far as necessary. When the bowl 18 is lowered during further swinging away from the building wall 19, the two pipe sections 15*a* and 15*b* will be rotated against one another around the vertical plane of the joint 15*c*, and the end of the pipe section 15*a* will be rapidly moved in the downward direction with the drain siphon 29, and the end of the pipe section 15*b* will rotate around its longitudinal axis in the drain line 17. When the bowl 18 is again swung against the building wall 19, the two pipe sections 15*a* and 15*b* are again returned into the horizontal direction, and at the same time, the elbow 15 is again pushed farther into the drain line 17, as is shown in FIG. 4*b*. Thus, the drain siphon 21 is not separated from the drain line 17 in this case, either.

Figure 5A:
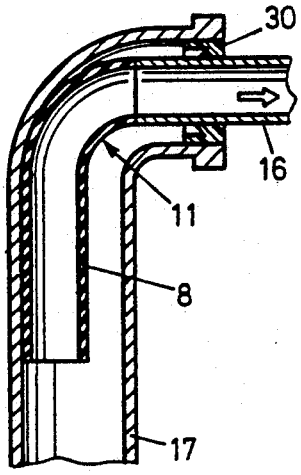
FIGS. 5*a* and 5*b* are schematic sectional views of another embodiment of a drain connection for a urinal.
Figure 5B:
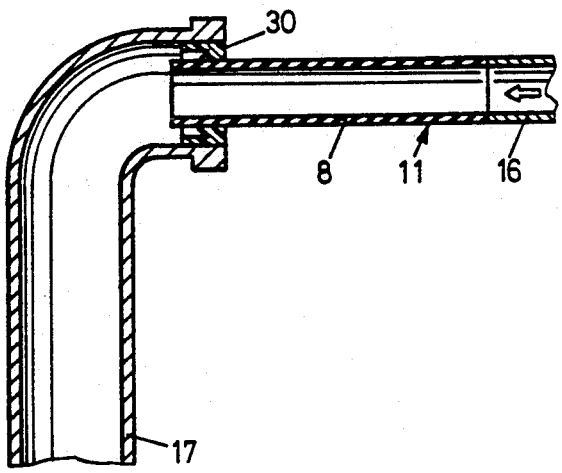

In the embodiment according to FIGS. 5*a* and 5*b*, an ordinary drain siphon 29 with a horizontal outlet is also connected to the socket 24 in the bowl 18. The siphon 29 is connected here to the drain line 17 by a pipe 11 having a flexible section 8 and a substantially more rigid section 16. The section 16 is a pipe section that is connected to the drain siphon 29 in the usual manner. The flexible hose tube section 8 is made of a plastic and is, e.g., butt-welded to the pipe section 16. FIG. 5*a* shows the pipe 11 in the position in which the urinal is in the use position. The flexible end 8 is fully pushed into the drain line 17 here and has, as is apparent, assumed the corresponding curvature of the drain elbow. If the bowl 18 is swung away from the building wall 19, the pipe 11 is partially pulled out of the drain line 17, and it will finally reach the stretched shape shown in FIG. 5*b*. When the bowl 18 is swung back to the building wall 19, the pipe 11 is again brought into the position shown in FIG. 5*a*, and the flexible end 8 will fully assume the bent shape. During the above-mentioned displacements of the pipe 11, a leathering 30 guarantees sealed connection between the pipe 11 and the drain line 17.

The connection according to the present invention is also suitable for other sanitary articles, e.g., wash basins or wall-mounted toilet bowls, which can be moved away from the building wall for maintenance.

While specific embodiments of the invention have been shown and described in detail to illustrate the application of the principles of the invention, it will be understood that the invention may be embodied otherwise without departing from such principles.

What is claimed is:

1. A urinal drain connection arrangement comprising: a urinal; a drain line arranged in a building wall; pivoting means for supporting said urinal and allowing said urinal to be swung between a first position against said building wall and a second position swung out from and completely spaced from said building wall; and, movable connection means for connecting said urinal to said drain line and maintaining said connection in each of said first position and said second position, said movable connection means including a siphon trap including first and second bends, said siphon trap being formed with elastically stretchable means at said bends for elastic deformation from an original state into a stretched state when said urinal is moved to said second position and for return to said original state when said urinal is moved to said first position.

2. A urinal drain connection according to claim 1 wherein said first and second bends each provide a reversal of direction of flow in said original state.

3. A drain connection on a sanitary article such as a urinal, comprising:

a drain line arranged in a building wall; pivoting means for supporting said sanitary article for positioning said sanitary article in a first position against said building wall and in a second position completely spaced away from said building wall; and movable siphon trap means including a first siphon trap end connected to said sanitary article and a second siphon trap end connected to said drain line, said siphon trap means including siphon trap bends formed of elastically stretchable material for elastically deforming at said stretchable bends as said sanitary article is moved from said first position to said second position and automatically elastically returning to an original state of said bends when said sanitary article is moved from said second position to said first position.

4. The drain connection according to claim 3, wherein said siphon trap means is formed of the elastomeric plastic.

5. The drain connection according to claim 4, wherein said siphon trap means formed of elastomeric plastic includes bends comprising a plurality of relatively thin-walled beads between which are arranged sections with greater wall thickness wherein upon stretching, said siphon trap means is deformed mainly in an area of said beads.

6. A drain connection according to claim 4, wherein said elastomeric plastic is EPDM.

7. A drain connection according to claim 6, wherein said siphon trap means is molded and cross-linked in order to attain high strength.

8. A drain connection according to claim 3, wherein said bends cause a reversal of direction of flow of approximately 180°.

* * * * *